US005996972A

United States Patent [19]

Kaiser

[11] Patent Number: 5,996,972

[45] **Date of Patent: *Dec. 7, 1999**

[54] WIRE ROPE NET FOR PROTECTION FENCES AGAINST FALLING ROCKS, AVALANCHES AND FELLING

[76] Inventor: Hermann Kaiser, Gibriststrasse 719, CH-5317 Hettenschwil, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/858,975

[22] Filed: May 20, 1997

[30] Foreign Application Priority Data

May 24, 1996 [CH] Switzerland ..... 1318/96

[51] Int. Cl.[6] ..... E04H 17/02

[52] U.S. Cl. ..... 256/12.5; 256/32; 256/45; 245/5

[58] Field of Search ..... 256/12.5, 32, 33, 256/45; 245/5, 2, 1

[56] References Cited

U.S. PATENT DOCUMENTS

| | | | |
|---|---|---|---|
| D. 29,160 | 8/1898 | Henley | 245/5 X |
| 142,450 | 9/1873 | Edge | 245/5 |
| 256,987 | 4/1882 | Dodge et al. | 245/5 |
| 448,455 | 3/1891 | Randall | 245/5 |
| 577,906 | 3/1897 | Wohlgemuth | 245/5 X |
| 750,903 | 2/1904 | Shrum et al. | 256/45 X |
| 769,180 | 9/1904 | Parrish | 245/5 |
| 929,502 | 7/1909 | Scott | 256/45 |
| 2,390,200 | 12/1945 | York | 245/5 X |
| 3,473,652 | 10/1969 | Verstraete | 256/32 X |
| 5,413,148 | 5/1995 | Mintz et al. . | |

FOREIGN PATENT DOCUMENTS

| | | | |
|---|---|---|---|
| 271855 | 6/1969 | Austria | 256/32 |
| 376459 | 5/1964 | Switzerland . | |
| 677 376 | 10/1988 | Switzerland . | |
| 435202 | 9/1935 | United Kingdom | 256/45 |
| 551595 | 3/1943 | United Kingdom | 245/5 |
| 602889 | 6/1948 | United Kingdom | 256/45 |
| WO 93/22751 | 11/1993 | WIPO . | |

*Primary Examiner*—Harry C. Kim
*Attorney, Agent, or Firm*—Merchant & Gould P.C.

[57] ABSTRACT

The wire rope net includes a plurality of meander-shaped wire ropes which form together a knitted meshed network.

4 Claims, 2 Drawing Sheets

WIRE ROPE NET FOR PROTECTION FENCES AGAINST FALLING ROCKS, AVALANCHES AND FELLING

BACKGROUND OF THE INVENTION

1. Field of the Invention

The present invention relates to a wire rope net for protection fences against falling rocks, avalanches and felling. Protection fences against felling are needed for instance at mountains slopes where trees are cut.

2. Description of the Prior Art

Such wire rope nets are generally set up between upright standing supporting beams which are firmly anchored in the ground, which nets are suspended by wire ropes at the supporting beams. The suspension wire ropes can be equipped with spring member apparatuses or extend through rope breaking members operative to absorb a certain amount of the energy of the matter impacting the wire rope net. A generally known construction of such wire rope nets features a network made up of assembled and interconnected ring-shaped wire rope portions.

These known wire rope nets are of a considerable weight and necessitate a large expenditure for their production because among others a large number of rings must be individually assembled.

SUMMARY OF THE INVENTION

Hence, it is a general object of the present invention to provide a wire rope net which includes a plurality of meander-shaped wire ropes interconnected in form of meshes in a form-locked state and form a knitted meshed network.

Yet a further object is to provide a method of producing a wire rope net for protection fences against falling rocks, avalanches and felling, which wire rope net includes a plurality of meander-shaped wire ropes interconnected in form of meshes in a form-locked state and form a knitted meshed network, which method includes a deforming of a plurality of wire ropes to attain a meander-like shape having meshes with head portions, and thereafter an inserting the head portions of the meshes of any respective meander-shaped wire rope into the head portions of the meshes of an adjacent meander-shaped wire rope to which the first named wire rope is to be coupled.

In comparison with a wire rope net which consists of assembled rings having the same mesh aperture as a wire rope net structured in accordance with the present invention approximately 20 per cent less wire rope is needed, which leads to considerably less material costs. The assembling of such wire proceeds in a much simpler manner.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
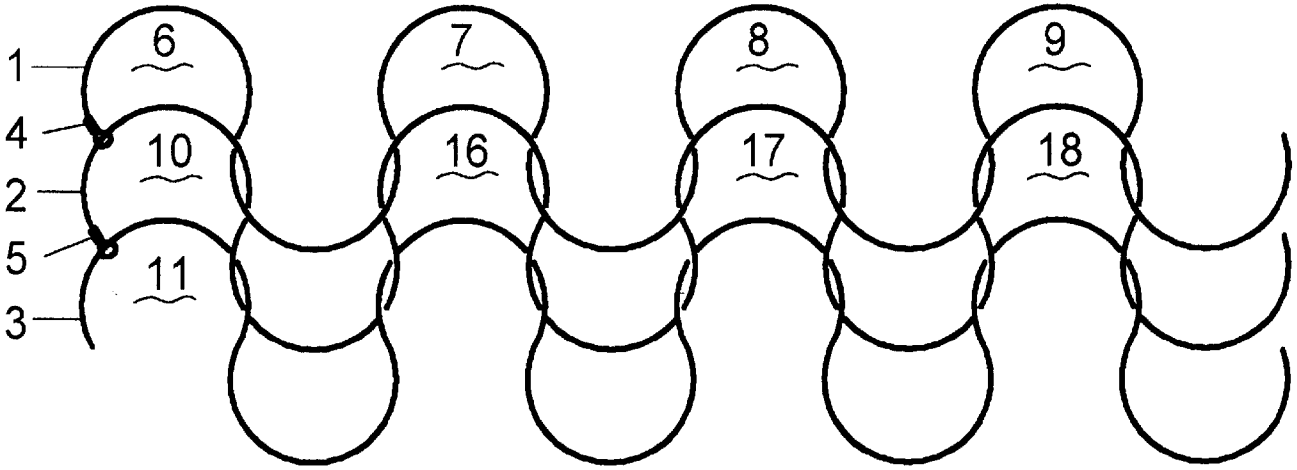
FIG. 1 illustrates schematically a part of a wire rope net.

FIG. 1 illustrates schematically a part of a wire rope net which is composed of a plurality of wire ropes 1, 2, 3, . . . which are interconnected in form of meshes. At their ends the wire ropes 1, 2, 3, . . . are mounted together by generally known mounting structures, such as loops, clamps, etc. which are identified by the reference numeral 4 and 5. One of the generally known wire ropes by means of which such wire rope nets are suspended at upright supports in a known manner extends through the loops 6, 7, 8, 9 of the uppermost wire rope 1, illustrated in FIG. 1, a further wire rope extend through the loops of the (not particularly illustrated) lowermost wire rope of the complete net, and through the outermost loops 6, 10, 11 at the left and (not illustrated) right end of the wire rope net. Such arrangement is generally known.

Figure 3:
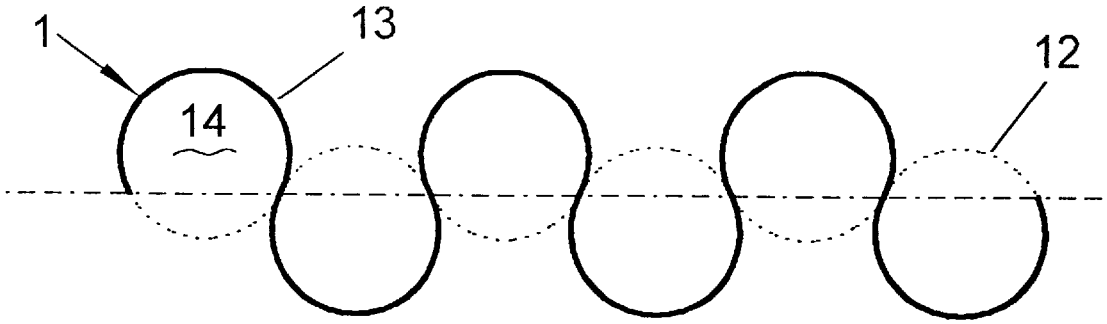
FIG. 3 illustrates schematically a meander-like deformed wire rope for an illustrating of the geometric shape of the meshes.

The wire ropes 1, 2, 3 may have variously shaped meander-like meshes, i.e. the individual meshes can display various shapes. The preferred shape is illustrated in FIG. 3. It can be seen that the shape of the meshes is based on a circle. The wire rope is shown in a solid line, and the geometrical portion of the arcs which would complete the wire rope loops which have the shape of an arc of a circle to a complete circle are drawn by dotted lines and are identified by the reference numeral 12. It thus can be seen, that the head 13 of every mesh 14 defines an arc of a circle having an angle at the centre of more than 180°. It can be seen further that the meshes include basically only a (curvilinear) mesh head but no (more or less rectilinear) mesh legs. Thus, adjoining meshes 14 are joined directly at the heads 13, whereby respective adjoining heads face in opposite directions.

The production of the wire rope net is extremely simple and will now be explained with reference to FIG. 2.

Figure 2:
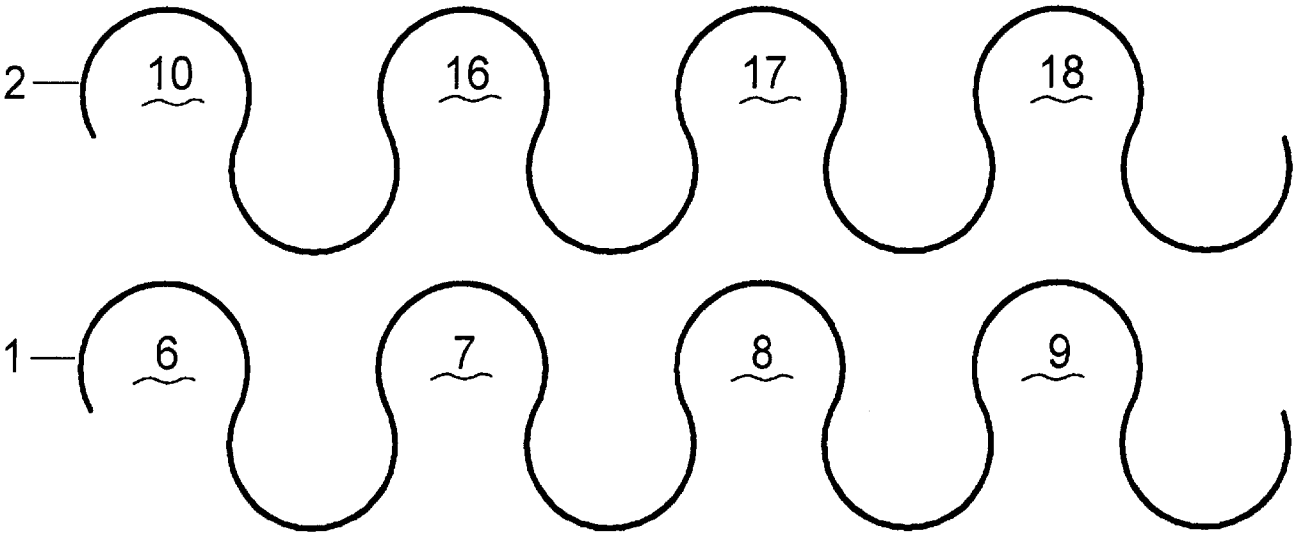
FIG. 2 illustrates schematically two meander-like deformed wire nets for the illustration of the method of production.

A first wire rope 2 is shaped by a shaping apparatus to a meander-like shape as illustrated in FIG. 2 such that the illustrated heads 10, 16, 17, 18, . . . are produced. Therefore, a second wire rope 1 is shaped in the same manner such that the heads 6, 7, 8, 9, . . . are produced. Thereafter, the wire rope 1 is slid towards the wire rope 2 and all heads 6, 7, 8, 9 are inserted from above relative to the plane of the drawing of FIG. 2 through the heads 10, 16, 17, 18, . . . such that an arrangement or assembly of the two wire ropes 1, 2 is reached which is designed in FIG. 1. A next following wire rope is than inserted through the heads 6, 7, 8, 9, . . . and this procedure is repeated with any further wire ropes until the complete wire net is assembled.

While there is shown and described a present preferred embodiment of the invention, it is to be distinctly understood that the invention is not limited thereto, but may be otherwise variously embodied and practised within the scope of the following claims.

I claim:

1. A protection fence, including a wire rope net comprising a plurality of meander-shaped wire ropes interconnected in form of meshes in a form-locked state and forming a knitted meshed network, wherein each meander-shaped wire rope includes a plurality of meanders, wherein a first meander on a first wire rope embraces a second meander on a second wire rope from below the second meander, and wherein a third meander on a third wire rope embraces the first meander from above the first meander, and wherein the third meander does not embrace the second meander.

2. The protection fence of claim 1, wherein every mesh includes a head portion and the head portion of every mesh of the meshed network forms at least approximately an arc of a circle having an angle at the center of more than 180°, and in which the head portion of adjacent meshes of each meander-shaped wire rope project in opposite directions.

3. The protection fence of claim 1, wherein the head portions of all meshes are of the same shape.

4. A method of producing a protection fence including a wire rope net, which wire rope net includes a plurality of meander-shaped wire ropes interconnected in form of meshes in a form-locked state and forming a knitted meshed network, comprising the steps of:

deforming a plurality of wire ropes to provide each of the wire ropes with a plurality of meanders, inserting meanders of a first wire rope from below into corresponding meanders of a second wire rope, and inserting meanders of a third wire rope from above into the meanders of the first wire rope but not through the meanders of the second wire rope.

* * * * *